US010465382B2

(12) United States Patent
Rice

(10) Patent No.: US 10,465,382 B2
(45) Date of Patent: Nov. 5, 2019

(54) METAL STUD FOR USE IN SOUND ATTENUATING WALL SYSTEM UTILIZING HIGH DENSITY WALLBOARD

(71) Applicant: Bailey Metal Products Limited, Concord (CA)

(72) Inventor: John Rice, Napanee (CA)

(73) Assignee: Bailey Metal Products Limited, Concord, ON (CA)

( * ) Notice: Subject to any disclaimer, the term of this patent is extended or adjusted under 35 U.S.C. 154(b) by 0 days.

(21) Appl. No.: 15/365,937

(22) Filed: Nov. 30, 2016

(65) Prior Publication Data

US 2018/0148925 A1 May 31, 2018

(51) Int. Cl.
*E04B 2/74* (2006.01)

(52) U.S. Cl.
CPC ..... *E04B 2/7457* (2013.01); *E04B 2/7412* (2013.01)

(58) Field of Classification Search
CPC ..... E04B 2/60; E04B 1/84; E04C 2003/0473
USPC ..... 52/483.1
See application file for complete search history.

(56) References Cited

U.S. PATENT DOCUMENTS 3,243,930 A * 4/1966 Slowinski ..... E04B 2/7457 52/363
4,580,388 A * 4/1986 Maisch ..... E04C 3/07 52/846
5,157,883 A * 10/1992 Meyer ..... E04B 2/766 24/460
5,592,796 A * 1/1997 Landers ..... E04B 2/7457 52/241
5,924,256 A * 7/1999 Ito ..... E04B 2/58 52/243
5,927,041 A * 7/1999 Sedlmeier ..... E04B 9/064 248/49
6,660,938 B2 * 12/2003 Herb ..... E04C 3/07 174/101
D606,211 S * 12/2009 Frobosilo ..... D25/121
D618,365 S * 6/2010 Crane ..... D25/121
(Continued)

OTHER PUBLICATIONS

Scafco Steel Stud Company, Supreme Framing System, catalog, Jan. 13, 2016, 36 pages.

*Primary Examiner* — Babajide A Demuren

(57) ABSTRACT

The present invention provides for a metal stud for use in sound attenuating wall systems utilizing high density, abuse resistant wallboard, the metal stud having specific steel chemical and mechanical properties to result in increased sound attenuation properties while maintaining the load carrying capacity and screw performance providing improved economics. The metal stud is a generally C shaped metal stud constructed of 0.0180 steel having at least 57 ksi strength having two parallel spaced apart flanges joined along the length of one edge by a central web and being provided with an in-turned double thickness hemmed ledge along the length of the second edge, the flanges having a width of greater than 1⅜ inches between the one edge and the second edge, each of the flanges being provided with a reinforcing rib centrally located in the flange extending the length of the flange. The central web has a main central section bordered by channel shaped ribs extending longitudinally of the stud outwardly of the central web, the edges connected to the edges of the flange.

2 Claims, 2 Drawing Sheets

(56) References Cited

U.S. PATENT DOCUMENTS

D621,963 S * 8/2010 Zadeh ..... E04B 2/767 D25/121
D621,964 S * 8/2010 Zadeh ..... E04B 2/767 D25/121
8,056,303 B2 * 11/2011 Frobosilo ..... E04C 3/09 52/831
8,307,610 B2 * 11/2012 Landers ..... E04C 3/07 52/144
D709,629 S * 7/2014 Rice ..... D25/125
9,010,070 B2 * 4/2015 Darr ..... E04B 2/7457 52/481.1
2004/0083665 A1 * 5/2004 Surowiecki ..... E04B 2/7457 52/301
2005/0081477 A1 * 4/2005 St. Quinton ..... E04B 2/7881 52/846
2005/0241261 A1 * 11/2005 Martinez-Cepeda ..... E04C 3/07 52/843
2007/0193202 A1 * 8/2007 Rice ..... E04B 2/7457 52/481.1
2008/0110126 A1 * 5/2008 Howchin ..... E04C 3/07 52/630
2008/0250738 A1 * 10/2008 Howchin ..... E04B 2/789 52/235
2009/0113827 A1 * 5/2009 Stone ..... E04C 3/07 52/846
2009/0113845 A1 * 5/2009 Knauf ..... E04C 3/07 52/846
2009/0113846 A1 * 5/2009 Knauf ..... E04B 2/789 52/846
2009/0126315 A1 * 5/2009 Knauf ..... E04C 3/07 52/846
2012/0000149 A1 * 1/2012 Rice ..... E04B 2/7412 52/173.1

* cited by examiner

METAL STUD FOR USE IN SOUND ATTENUATING WALL SYSTEM UTILIZING HIGH DENSITY WALLBOARD

FIELD OF THE INVENTION

The present invention is directed to a metal stud for use in sound attenuating wall systems utilizing high density wallboard and in particular to a metal stud having specific steel chemical and mechanical properties to result in increased sound attenuation properties providing improved economics.

BACKGROUND OF THE INVENTION

In most institutional and commercial premises partition walls are constructed utilizing metal studs with wallboard attached to the metal stud. The use of the metal stud for the partition walls satisfies requirements for fire rating of the partition walls. In recent years, the requirement for confidentiality, particularly in institutional settings such as hospitals, has required that the partition walls be constructed to attenuate sounds from being transmitted through the partition wall.

In order to achieve the required sound attenuation, it has been necessary in the past to utilize multiple layers of wallboard on the surface of the partition wall. In some cases, particularly when utilizing heavier gauge metal studs up to five layers of wallboard may be required with two layers on one side of the partition wall and three layers on the other side.

Another prior solution to the reduction of sound transmission through the partition wall utilized resilient channels on one or both of the partition wall surfaces. These resilient channels space the wallboard away from the metal studs and reduce the area through which sound can be transmitted through the wall. While the use of resilient channel reduces the layers of wallboard required in the partition wall they also have the drawback of making it more difficult to attach structures to the surface of the partition wall thus reducing the ability of the partition wall to support a load.

Another solution to the reduction of sound transmission has been the provision of special structures in the web of the stud to reduce the ability of sound to travel in a straight line across the web the stud. However, such structures also reduce the load carrying capacity of the metal stud and could result in a flimsy partition wall.

Another problem in institutional settings such as hospitals, is that the walls take a fair amount of abuse, being struck by equipment such as stretchers, carts, etc. Recently, wall board manufacturers have developed abuse resistant products which have stronger paper surfaces and higher density cores than standard wall board. For extreme conditions, the abuse resistant board may also have fiberglass mesh imbedded in the core. However, the use of the denser and harder abuse resistant wallboard can cause problems with screw penetration through the wall board and underlying stud thus possibly affecting screw performance with lighter gauge metal studs which are employed to achieve the reduction of sound transmission.

There thus remains a need for a stud for use in a wall having at least one layer of abuse resistant wall board capable of maintaining the load carrying capacity and screw performance while having improved properties in reducing sound transmission across the metal stud.

SUMMARY OF THE INVENTION

The present invention provides for a metal stud for use in sound attenuating wall systems utilizing high density, abuse resistant wallboard, the metal stud having specific steel chemical and mechanical properties to result in increased sound attenuation properties while maintaining the load carrying capacity and screw performance providing improved economics.

The metal stud is a generally C shaped metal stud constructed of 0.0180 steel having at least 57 ksi strength having two parallel spaced apart flanges joined along the length of one edge by a central web and being provided with an in-turned double thickness hemmed ledge along the length of the second edge, the flanges having a width of greater than 1⅜ inches between the one edge and the second edge, each of the flanges being provided with a reinforcing rib centrally located in the flange extending the length of the flange. The central web has a main central section bordered by channel shaped ribs extending longitudinally of the stud outwardly of the central web, the edges connected to the edges of the flange.

In an aspect of the invention there is provided a metal stud wall having top and bottom generally U-shaped tracks, the top track being attached to the ceiling of the space and the bottom track being attached to the floor of the space. The wall has a plurality of parallel spaced apart metal studs, each of the metal studs being a generally C shaped metal stud constructed of 0.0180 steel having at least 57 ksi strength having two parallel spaced apart flanges joined along the length of one edge by a central web and being provided with an in-turned double thickness hemmed ledge along the length of the second edge, the flanges having a width of greater than 1⅜ inches between the one edge and the second edge, each of the flanges being provided with a reinforcing rib centrally located in the flange extending the length of the flange. The central web has a main central section bordered by channel shaped ribs extending longitudinally of the stud outwardly of the central web, the edges connected to the edges of the flanges. The flanges of the metal stud at the end thereof are connected to the top and bottom tracks by means of suitable fastening means. At least one layer of wallboard is attached to the flanges of the metal studs on each side, at least one of the layers of wallboard being a high density, abuse resistant wallboard.

BRIEF DESCRIPTION OF THE DRAWINGS

Preferred embodiments of the present invention are illustrated in the attached figures in which.

DETAILED DESCRIPTION OF THE PREFERRED EMBODIMENTS

Figure 1:
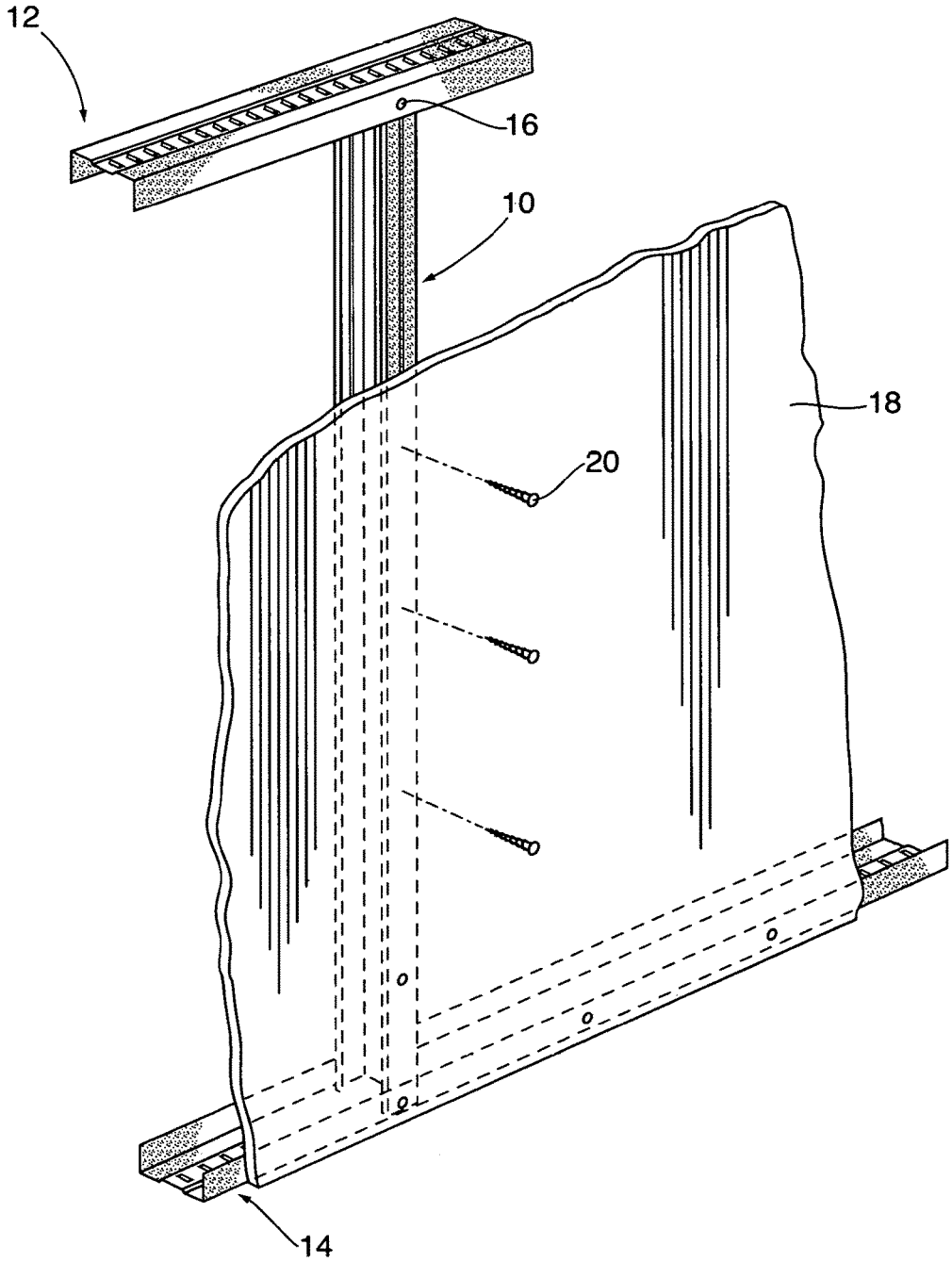
FIG. 1 is a perspective view of a wall system utilizing the stud of the present invention.

The present invention is directed to metal studs for use in sound attenuating wall systems utilizing high density, abuse resistant wallboard. As illustrated in FIG. 1, the wall system comprises a plurality of parallel spaced apart metal studs 10 of the present invention attached to a top track 12 and a bottom track 14 by suitable fasteners 16. A wallboard 18 is attached to each side of the wall system by suitable fasteners such as screws 20. As explained below, there may be more than one layer of wallboard 18 on each of the sides. The outermost layer of the wallboard 18 on at least one side is a high density, abuse resistant wallboard.

Figure 2:
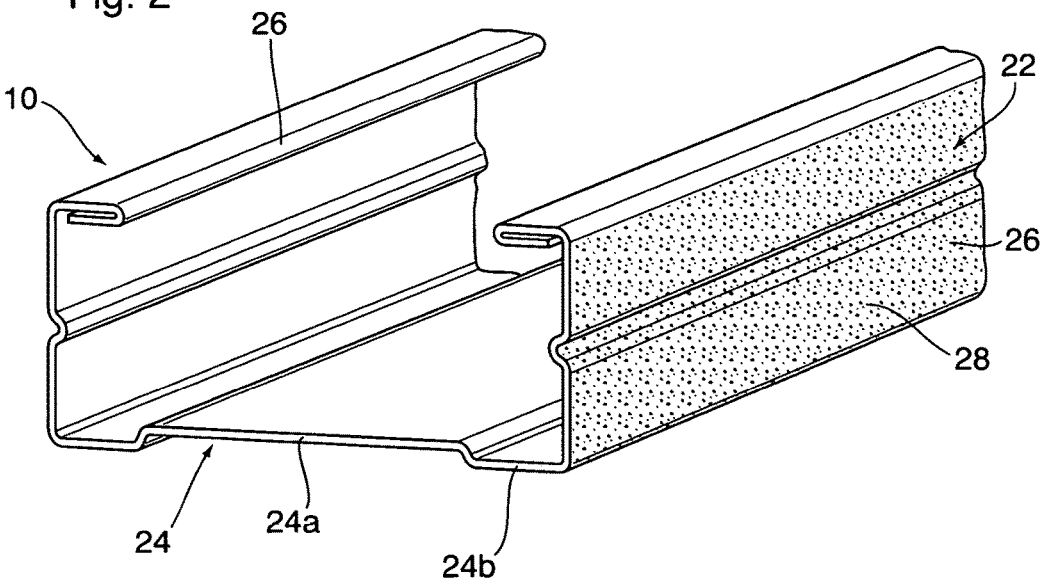
FIG. 2 is a perspective view of the metal stud of the present invention.
Figure 3:
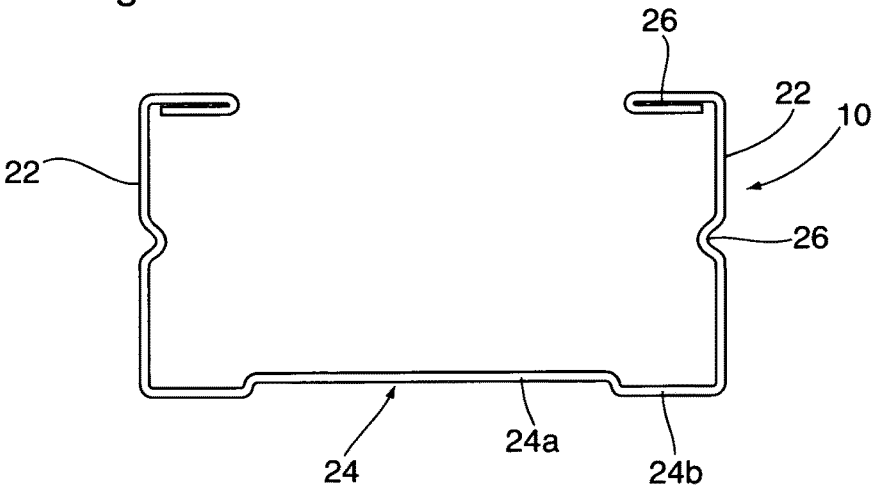
FIG. 3 is an end view of the metal stud of the present invention.

As illustrated in FIGS. 2 and 3, metal stud 10 has a generally C shaped rectangular cross-section with two parallel spaced apart flanges 22 and a central web 24 bridging the flanges 22 along one edge of the flanges 22. The second edge of the flange 22 is provided with a double thickness hemmed inwardly turned ledge 26. The central web 24 has a main central section 24*a* bordered by channel shaped ribs 24*b* extending longitudinally of the stud 10. The longitudinal ribs 24*b* extend outwardly of the central web 24 of the stud 10 and aid in stiffening of the central web 24 of the stud 10. The flanges 22 are provided with longitudinally extending reinforcing ribs 26 centrally located in the flange 22 to increase the strength of the flange 22. The flanges 22 are also preferably provided with depressions 28 which aid in capturing the tip of the screw 20 as it is driven through the wallboard and into the flange of the stud. The flanges have a width of greater than 1⅜ inches and preferably a width of 1⁷⁄₁₆ inches.

The use of the combination of the 0.0180 thick at least 57 ksi steel as well as the provision of the longitudinal ribs 26 in the flanges 22 and the channel shaped ridges 24*b* in the central web 24 provide the metal studs with improved load carrying capacity as compared to equivalent thickness of conventional metal studs. Composite limiting height tests were performed comparing a metal stud of the present invention to conventional studs utilizing 20 gauge. Each of the studs were 3⅝ wide on 24 inch spacing under 5 PSF L/240. The 20 gauge conventional stud had a composite limiting height of 14' 8" and the stud of the present invention had a composite limiting height of 15' 6". Thus, the stud of the present invention had structural performance greater than 20 gauge.

Drywall screw pull-out test were performed on the stud of the present invention and a standard 25 gauge stud. The stud of the present invention had an average of 152.5 lbs compared to 115.6 lbs for the 25 gauge stud. Thus, the stud of the present invention has improved screw performance.

The sound attenuation properties of the stud of the present invention were compared to standard 25 gauge studs at 24 inches on centre by measuring airborne sound transmission loss in accordance with ASTM E90. The results are shown in the following table

ABLE 1

| TSTC Performance | | | |
|---|---|---|---|
| Stud | 1 + 1 insulated | 1 + 2 insulated | 2 + 2 insulated |
| 25 GA Stardard stud | 48 | 53 | 56 |
| Stud of Present Invention | 48 | 53 | 57 |

Thus, the stud of the present invention has sound attenuation properties equivalent to standard 25 gauge studs.

The stud of the present invention provides strength equal to or better than standard 20 gauge studs and sound attenuation properties equal to or better than standard 25 gauge studs. Thus, the stud provides the advantage of the strength of a 20 gauge and the sound attenuation properties of a 25 guage stud.

Although various preferred embodiments of the present invention have been described herein in detail, it will be appreciated by those skilled in the art that variations may be made thereto without departing from the scope of the appended claims.

The invention claimed is:

1. A metal stud for use in sound attenuating wall systems utilizing high density, abuse resistant wallboard, the metal stud comprising a generally C shaped metal stud constructed of 0.0180 inch steel having a yield strength of 57 ksi with said metal steel having two parallel spaced apart flanges joined along the length of one edge by a central web and being provided with an in-turned double thickness hemmed ledge along the length of the second edge, the flanges having a width of greater than 1⅜ inches between the one edge and the second edge, each of the flanges being provided with a reinforcing rib centrally located and displace inwardly to one side of the flange and extending the length of the flange, the central web having a main central section bordered by channel shaped ribs extending longitudinally of the stud outwardly of the central web, the edges connected to the edges of the flange, wherein the metal stud provides increased sound attenuation properties while having a composite limiting height in excess of 14 feet, 8 inches based on a stud spacing of 24 inches and maintains screw performance.

2. A metal stud wall comprising top and bottom generally U-shaped tracks, the top track being attached to the ceiling of a space and the bottom track being attached to a floor of the space, a plurality of parallel spaced apart metal studs bridging the top and bottom tracks and having the ends located within the tracks, each of the metal studs being a generally C shaped metal stud constructed of 0.0180 inch steel having a yield strength of 57 ksi and having two parallel spaced apart flanges joined along the length of one edge by a central web and being provided with an in-turned double thickness hemmed ledge along the length of the second edge, the flanges having a width of greater than 1⅜ inches between the one edge and the second edge, each of the flanges being provided with a an inwardly displace reinforcing rib centrally located in the flange extending the length of the flange, the central web having a main central section bordered by channel shaped ribs extending longitudinally of the stud outwardly of the central web, the edges connected to the edges of the flanges, the flanges of the metal stud at each of the ends thereof are connected to the top and bottom tracks by means of suitable fastening means, at least one layer of wallboard being attached to the flanges of the metal studs on each side, at least one of the layers of wallboard being a high density, abuse resistant wallboard and wherein said studs have a composite limiting height in excess of 14 feet, 8 inches based on a stud spacing of 24 inches.

* * * * *